US010470586B2

(12) United States Patent
D'Urso et al.

(10) Patent No.: US 10,470,586 B2
(45) Date of Patent: Nov. 12, 2019

(54) COLLAPSIBLE BREATHABLE MATTRESS

(71) Applicant: Baby Trend, Inc., Ontario, CA (US)

(72) Inventors: Stellario D'Urso, Chester, NJ (US); Hans H. Pompen, Redwood City, CA (US); Bradley James Mattarocci, Rancho Cucamonga, CA (US)

(73) Assignee: Baby Trend, Inc., Ontario, CA (US)

( * ) Notice: Subject to any disclaimer, the term of this patent is extended or adjusted under 35 U.S.C. 154(b) by 0 days.

(21) Appl. No.: 15/949,047

(22) Filed: Apr. 9, 2018

(65) Prior Publication Data

US 2018/0220809 A1 Aug. 9, 2018

Related U.S. Application Data

(63) Continuation-in-part of application No. 15/294,455, filed on Oct. 14, 2016, now Pat. No. 9,936,821.

(60) Provisional application No. 62/241,573, filed on Oct. 14, 2015.

(51) Int. Cl.

| | |
|---|---|
| ***A47D 7/00*** | (2006.01) |
| ***A47D 15/00*** | (2006.01) |
| ***A47D 9/00*** | (2006.01) |
| ***A47D 13/06*** | (2006.01) |

(52) U.S. Cl.

CPC ..... *A47D 15/003* (2013.01); *A47D 9/00* (2013.01); *A47D 13/06* (2013.01)

(58) Field of Classification Search

CPC ..... A47D 7/00; A47D 7/01; A47D 13/00
USPC ..... 5/690, 722, 99.1, 655
See application file for complete search history.

(56) References Cited

U.S. PATENT DOCUMENTS

| | | | |
|---|---|---|---|
| 1,736,341 | A | 11/1929 | Fritz |
| 2,218,978 | A | 9/1938 | Akin |
| 2,287,907 | A | 6/1942 | Schettler |
| 2,459,445 | A | 1/1949 | McClintock |
| 2,607,930 | A | 8/1952 | Schettler |
| 2,692,993 | A | 11/1954 | Joseph |
| 2,695,415 | A | 11/1954 | Holton |

(Continued)

FOREIGN PATENT DOCUMENTS

| | | | |
|---|---|---|---|
| CN | 204995054 | U | 1/2016 |
| CN | 204995061 | U | 1/2016 |

(Continued)

OTHER PUBLICATIONS

International Search Report and Written Opinion issued by the ISA/US, dated Mar. 31, 2017 for International Application No. PCT/IB2016/001533; 9 pages.

(Continued)

*Primary Examiner* — Fredrick C Conley
(74) *Attorney, Agent, or Firm* — Faegre Baker Daniels LLP

(57) ABSTRACT

A mattress configured to form a sleeping surface in a playard is provided, comprising: an air permeable cover; and a frame including a pair hinges; wherein the cover includes a plurality of extensions that extend over the frame and opposing extensions of the plurality of extensions are connected together by a fastener that permits adjustment of a relative position of the opposing extensions to adjust a tension applied to the cover; wherein the cover includes a pair of side segments that are configured to be fixedly secured to the frame; and wherein the pair of hinges permit movement of the mattress between an expanded state and a collapsed state.

21 Claims, 16 Drawing Sheets

(56) References Cited

U.S. PATENT DOCUMENTS

| | | | | |
|---|---|---|---|---|
| 2,815,516 | A | 12/1957 | Holton | |
| 2,924,832 | A | 2/1960 | Knowles | |
| 3,266,064 | A | 8/1966 | Murray | |
| 4,663,787 | A | 5/1987 | Koelsch | |
| 4,698,862 | A | 10/1987 | Mairs | |
| 4,730,356 | A | 3/1988 | Suzuki | |
| 5,016,301 | A | 5/1991 | Combs | |
| 5,212,841 | A | 5/1993 | Binnersley | |
| 5,303,438 | A | 4/1994 | Walker | |
| 5,351,348 | A | 10/1994 | Beger | |
| D353,494 | S | 12/1994 | Beger | |
| 5,423,099 | A | 6/1995 | Gulli | |
| 5,454,124 | A | 10/1995 | Huang | |
| 5,463,785 | A | 11/1995 | McKeel | |
| 5,490,292 | A | 2/1996 | Auburn | |
| 5,546,618 | A | 8/1996 | Beedy et al. | |
| 5,555,577 | A | 9/1996 | Volpe | |
| 5,561,876 | A | 10/1996 | Petruzella | |
| 5,566,407 | A | 10/1996 | Lien | |
| 5,664,273 | A | 9/1997 | Obriot | |
| 5,675,852 | A | 10/1997 | Watkins | |
| 5,697,113 | A | 12/1997 | Shatz et al. | |
| 5,699,571 | A * | 12/1997 | Yowell | A47C 21/046 5/652.1 |
| 5,787,534 | A | 8/1998 | Hargest et al. | |
| 5,855,031 | A | 1/1999 | Swift | |
| 5,857,232 | A | 1/1999 | Mahdavi | |
| 5,870,785 | A | 2/1999 | Hoorens | |
| 5,887,304 | A | 3/1999 | Von | |
| 6,026,525 | A | 2/2000 | Davis | |
| 6,055,690 | A | 5/2000 | Koenig | |
| 6,131,220 | A | 10/2000 | Morimura | |
| 6,182,315 | B1 | 2/2001 | Lee | |
| 6,336,237 | B1 | 1/2002 | Schmid | |
| 6,370,718 | B1 | 4/2002 | Schmid | |
| 6,425,152 | B1 | 7/2002 | Quarles | |
| 6,434,767 | B1 | 8/2002 | Welsh, Jr. | |
| 6,438,775 | B1 | 8/2002 | Koenig | |
| 6,493,888 | B1 | 12/2002 | Salvatini et al. | |
| 6,684,437 | B2 | 2/2004 | Koenig | |
| 6,823,547 | B1 | 11/2004 | Harding et al. | |
| 6,854,143 | B2 | 2/2005 | Sharples | |
| 7,127,763 | B1 | 10/2006 | Schmid et al. | |
| 7,334,280 | B1 | 2/2008 | Swartzburg | |
| 7,404,219 | B2 | 7/2008 | Berkey | |
| 7,406,727 | B2 | 8/2008 | Wickstrom et al. | |
| 7,426,767 | B2 | 9/2008 | Mossbeck | |
| 7,614,098 | B1 * | 11/2009 | Quarry | A47C 7/407 24/13 |
| 7,681,260 | B2 | 3/2010 | Hallock et al. | |
| 8,065,767 | B2 | 11/2011 | Gabbai et al. | |
| 8,220,088 | B2 | 7/2012 | Waters et al. | |
| 8,261,381 | B2 | 9/2012 | Hallock et al. | |
| 8,407,834 | B1 | 4/2013 | Oh | |
| 8,434,179 | B2 | 5/2013 | Reeves et al. | |
| 8,539,628 | B2 | 9/2013 | Lee | |
| 8,590,075 | B1 | 11/2013 | Amjad et al. | |
| 8,607,390 | B2 | 12/2013 | Obriot et al. | |
| 8,621,687 | B2 | 1/2014 | Brykalski et al. | |
| 8,745,793 | B2 | 6/2014 | Bensoussan | |
| 8,769,746 | B2 | 7/2014 | Abadi | |
| 8,935,821 | B2 | 1/2015 | Obriot | |
| 9,247,831 | B2 | 2/2016 | Miles et al. | |
| 2006/0207023 | A1 | 9/2006 | DeHart et al. | |
| 2007/0261173 | A1 | 11/2007 | Schlussel | |
| 2009/0217458 | A1 | 9/2009 | Lord | |
| 2013/0125304 | A1 | 5/2013 | DeHart | |
| 2013/0291311 | A1 | 11/2013 | Wang | |
| 2014/0033441 | A1 | 2/2014 | Morgan et al. | |

FOREIGN PATENT DOCUMENTS

| | | | |
|---|---|---|---|
| DE | 2448882 | A1 | 4/1976 |
| EP | 0852472 | B1 | 5/2003 |
| WO | WO9305685 | | 4/1993 |
| WO | WO 2006/048612 | A1 | 5/2006 |
| WO | WO 2007/031780 | A1 | 3/2007 |
| WO | WO 2011/035285 | A2 | 3/2011 |

OTHER PUBLICATIONS

International Preliminary Report on Patentability issued by The International Bureau of WIP, Geneva, Switzerland, Apr. 17, 2018, for International Application No. PCT/IB2016/001533; 4 pages.

* cited by examiner

COLLAPSIBLE BREATHABLE MATTRESS

CROSS-REFERENCE TO RELATED APPLICATIONS

This application claims priority to and is a continuation-in-part of U.S. patent application Ser. No. 15/294,455, filed on Oct. 14, 2016, entitled "COLLAPSIBLE BREATHABLE MATTRESS," which is a non-provisional filing that claims priority to U.S. Provisional Application No. 62/241,573, filed on Oct. 14, 2015, the entire disclosures of which being hereby expressly incorporated herein by reference.

TECHNICAL FIELD

The disclosed subject matter relates to a ventilated mattress especially for use in bedding for babies, toddlers and small children.

BACKGROUND

The sleeping needs of babies and toddlers are of concern for parents. Frequently, parents place their baby or toddler in enclosed bedding (e.g., a crib or playard) in order to prevent their baby or toddler from falling from the bed. Traditional mattresses are difficult to clean and can allow undesired buildup of heat in or near the child, and provide inadequate ventilation. Accordingly, it is desirable to provide a new ventilated mattress for babies and toddlers.

SUMMARY

In one embodiment, the present disclosure provides a mattress configured to form a sleeping surface in a playard, comprising: an air permeable cover; and a frame including a pair of side bars and a pair of end mechanisms extending between the side bars; wherein the cover includes a main field and a plurality of extensions that extend from the main field, each of the extensions being configured to fold over one end mechanism and adjustably couple to another extension configured to fold over another end mechanism that is opposite the one end mechanism; wherein the cover includes a pair of side segments that extend from the main field and are configured to be fixedly secured to the pair of side bars; and wherein each of the pair of end mechanisms includes a hinge that permits movement of the mattress between an expanded state and a collapsed state. In one aspect of this embodiment, the air permeable cover is formed from at least one of a mesh material, a plastic or a fabric. In another aspect, the air permeable cover is formed from a hypoallergenic material. In yet another aspect, each of the pair of side bars includes a slot that receives a side segment of the cover. In still another aspect, each of the pair of side bars is connected to the pair of end mechanisms by a pair of couplings. In a further aspect of this embodiment, each of the pair of end mechanisms includes a first arm, a second arm and a hinge coupled to the first arm and the second arm to permit the first arm and the second arm to pivot toward one another to move the mattress into the collapsed state. In a variant of this aspect, the first arm of each of the pair of end mechanisms is coupled to one of the pair of side bars and the second arm of each of the pair of end mechanisms is coupled to another of the pair of side bars. In another aspect, each of the plurality of extensions is connected to one end of a strap, another end of each strap being coupled to a fastener. In a variant of this aspect, the other end of one of the straps is fixedly secured to a fastener and the other end of another one of the straps is adjustably connected to the fastener. In another variant, the fastener is a buckle.

In another embodiment, the present disclosure provides a mattress configured to form a sleeping surface in a playard, comprising: an air permeable cover; and a frame including a pair hinges; wherein the cover includes a plurality of extensions that extend over the frame and opposing extensions of the plurality of extensions are connected together by a fastener that permits adjustment of a relative position of the opposing extensions to adjust a tension applied to the cover; wherein the cover includes a pair of side segments that are configured to be fixedly secured to the frame; and wherein the pair of hinges permit movement of the mattress between an expanded state and a collapsed state. In one aspect of this embodiment, the frame further includes a pair of side bars and a pair of end mechanisms extending between the side bars, each of the plurality of extensions being configured to fold over one end mechanism. In a variant of this aspect, each of the pair of side bars includes a slot that receives a side segment of the cover. In another variant, each of the pair of end mechanisms includes a first arm, a second arm and a hinge coupled to the first arm and the second arm to permit the first arm and the second arm to pivot toward one another to move the mattress into the collapsed state. In a further variant, the first arm of each of the pair of end mechanisms is coupled to one of the pair of side bars and the second arm of each of the pair of end mechanisms is coupled to another of the pair of side bars. In another aspect of this embodiment, each of the pair of side segments is configured to be fixedly secured to one of the pair of side bars. In another aspect, the air permeable cover is formed from at least one of a mesh material, a plastic or a fabric. In yet another aspect, each of the plurality of extensions is connected to one end of a strap, another end of each strap being coupled to a fastener. In a variant of this aspect, the other end of one of the straps is fixedly secured to a fastener and the other end of another one of the straps is adjustably connected to the fastener.

In another embodiment, the present invention provides a playard, comprising: a pair of side walls; a pair of end walls; a bottom wall; a bassinet assembly suspended between the pair of side walls and the pair of end walls above the bottom wall, the bassinet assembly including a bottom wall; and a mattress configured to fit within the bassinet assembly and be supported by the bottom wall of the bassinet assembly, the mattress including an air permeable cover and a frame including a pair hinges; wherein the cover includes a plurality of extensions that extend over the frame and overlap a main field of the cover, pairs of the plurality of extensions being connected together by a fastener that permits adjustment of a relative position of the extensions in the pairs of extension to adjust a tension applied to the cover; wherein the cover includes a pair of side segments that are configured to be fixedly secured to the frame; and wherein the pair of hinges permit movement of the mattress between an expanded state and a collapsed state.

In yet another embodiment, the present disclosure provides a playard, comprising: a pair of side wall; a pair of end walls; a bottom wall; and a mattress configured to fit between the side walls and the end walls and be supported by the bottom wall, the mattress including an air permeable cover and a frame including a pair hinges; wherein the cover includes a plurality of extensions that extend over the frame and overlap a main field of the cover, pairs of the plurality of extensions being connected together by a fastener that permits adjustment of a relative position of the extensions in the pairs of extension to adjust a tension applied to the cover;

wherein the cover includes a pair of side segments that are configured to be fixedly secured to the frame; and wherein the pair of hinges permit movement of the mattress between an expanded state and a collapsed state.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

BRIEF DESCRIPTION OF THE DRAWINGS

The above-mentioned and other features of this disclosure and the manner of obtaining them will become more apparent and the disclosure itself will be better understood by reference to the following description of embodiments of the present disclosure taken in conjunction with the accompanying drawings, wherein.

Figure 1A:
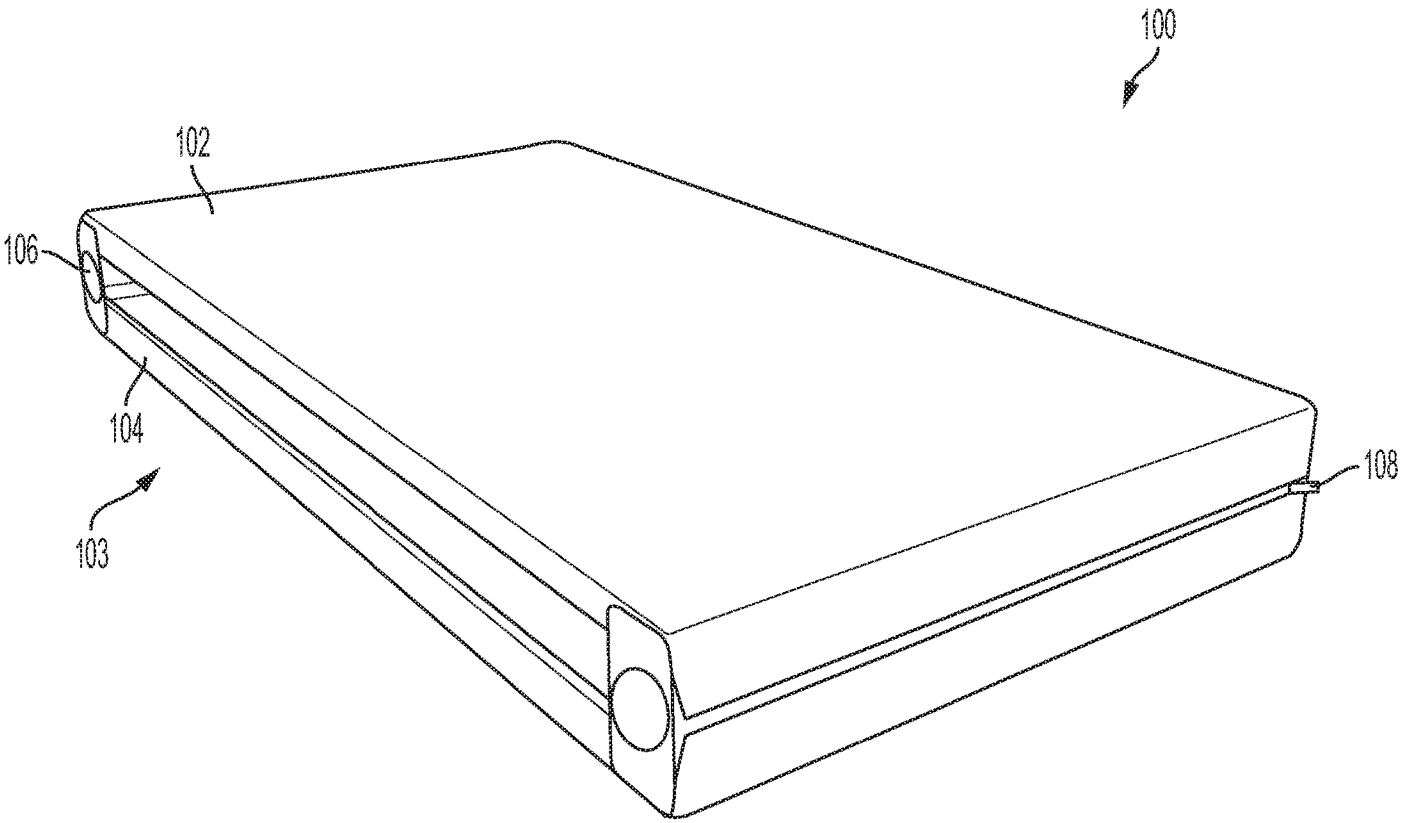
FIG. 1A is a perspective view of a first embodiment ventilated mattress.

While the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

DETAILED DESCRIPTION

Turning to FIGS. 1A, 1B, 1C, and 1D, an exemplary ventilated mattress 100 is shown. As illustrated, ventilated mattress 100 includes a cover 102, and a frame 103. The frame includes four frame bars 104, four hinge plates 106, two enclosure mechanisms 108, four tracks 110, eight folding arms 112, four hinges 114, and two hinges 116.

Figure 1B:
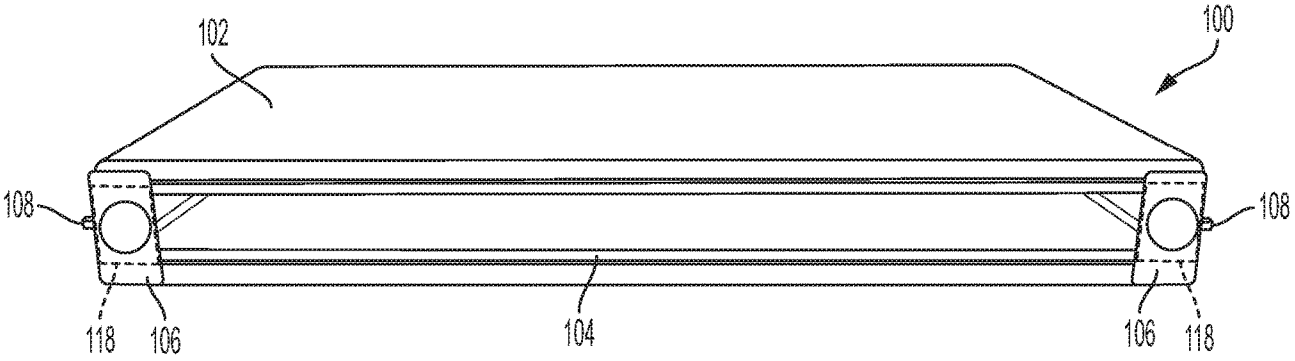
FIG. 1B is a side perspective view of the mattress of FIG. 1A.
Figure 1C:
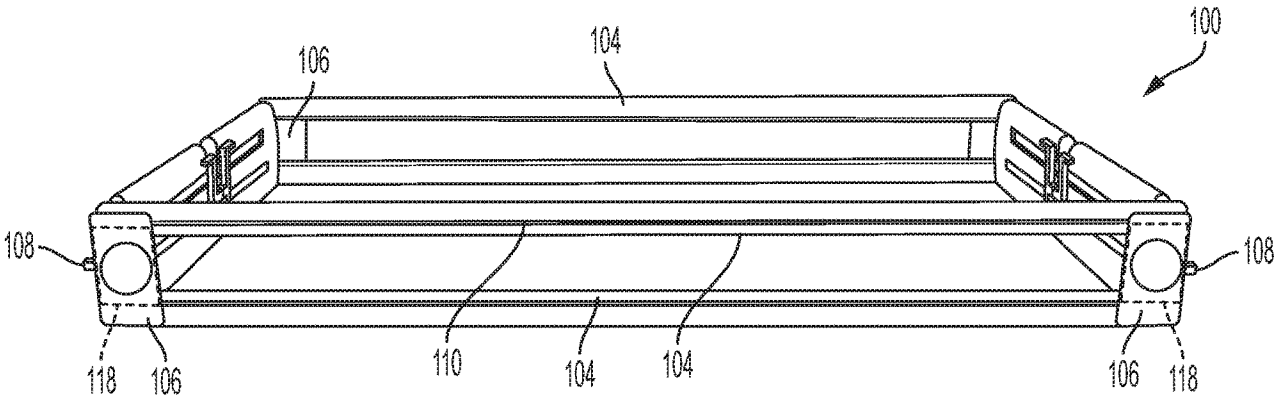
FIG. 1C is a side perspective view of the mattress of FIG. 1B with the upper support surface removed.
Figure 1D:
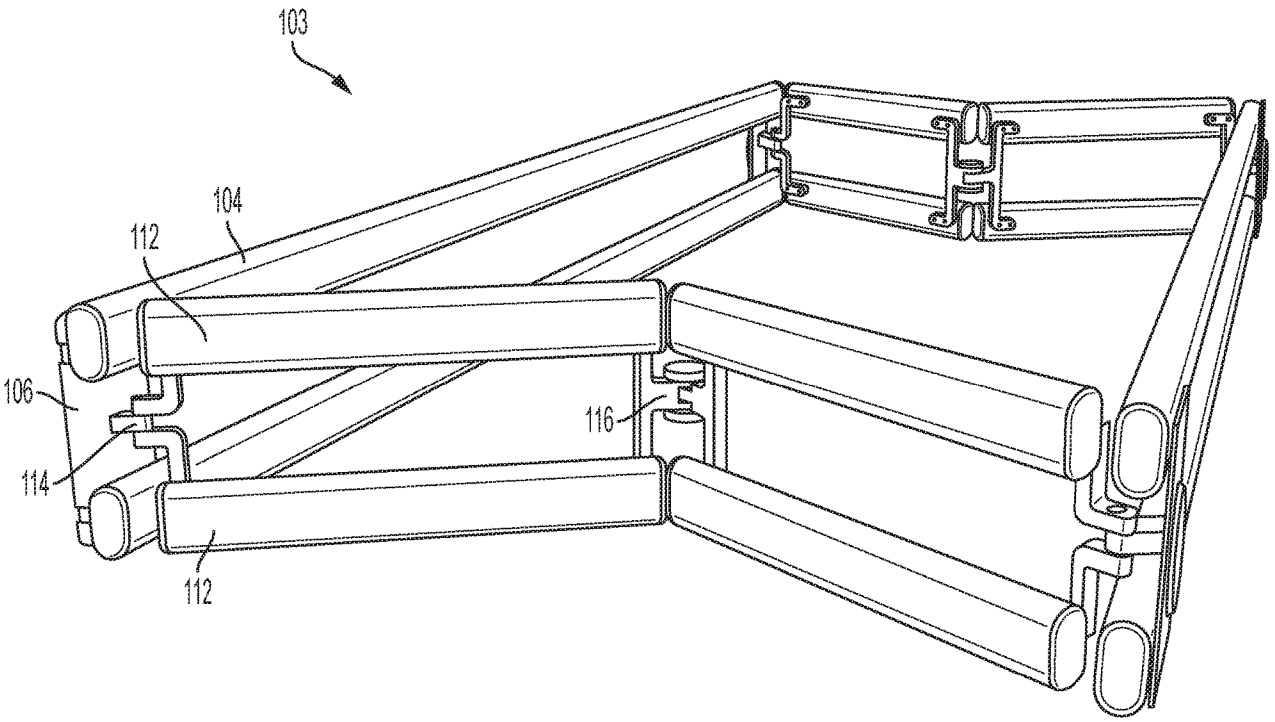
FIG. 1D is a perspective view of the support frame of the mattress of FIG. 1A, with the frame in a partially-collapsed orientation.

Ventilated mattress 100 is configured to have an expanded position and a collapsed position. For example, as illustrated in FIGS. 1A and 1B, ventilated mattress 100 has an expanded position configured to form a flat or substantially flat surface suitable for supporting a child during sleep. As another example ventilated mattress 100 has a collapsed position configured to reduce the effective size of ventilated mattress 100. FIG. 1D, shows mattress frame 103 in a partially collapsed position. As a more particular example, ventilated mattress 100, and specifically frame 103 can collapse more fully into a more compact size and shape suitable for transportation and/or storage.

In some embodiments, ventilated mattress 100 can be configured to have any suitable dimensions when in an expanded position. For example, ventilated mattress 100 can be configured to have dimensions matching regulated standards for crib mattresses. As a more particular example, ventilated mattress 100 can have a sleeping surface that is 27.5 inches wide and 51.5 inches long, and have a depth that is less than or equal to 6 inches.

In some embodiments, cover 102 includes any suitable air permeable material or materials. For example, cover 102 illustratively includes one or more of a mesh material, a plastic, a fabric, and/or any other suitable air permeable material. As a more particular example, cover 102 includes a washable, air permeable mesh material, such as a plastic mesh, a fiber mesh, a composite mesh, any suitable washable, air permeable mesh material, and/or any combination thereof. As a still more particular example, cover 102 can be made from the Extinct-Spacer mesh material supplied by Cosmo Hong Kong Limited, Zhongshan City, Guangdong, China.

In some embodiments, cover 102 can include a hypoallergenic material. For example, cover 102 can include a polyester fiber material, silk, cotton, any other suitable hypoallergenic material, and/or any suitable combination thereof.

Enclosure mechanism 108 can be any suitable enclosure mechanism. For example, enclosure mechanism 108 can be a clasp locker, zip fastener, a button, a series of buttons, any other suitable enclosure mechanism, and/or any suitable combination thereof.

In some embodiments, enclosure mechanism 108 and cover 102 are configured such that cover 102 forms two suitable sleeping surfaces when attached to itself via enclosure mechanism 108 and positioned over frame bars 104 and folding arms 112.

In some embodiments, cover 102 is configured such that, when ventilated mattress 100 is in an expanded position, cover 102 has a relatively firm sleeping surface on one side of ventilated mattress 100 and a relatively soft sleeping surface on another side of ventilated mattress 100. For example, cover 102 can include different materials having different hardness and/or elastic properties. In such an example, a length of cover 102 can be made of a relatively soft and/or relatively elastic material while another length of cover 102 can be made of a relatively firm and/or relatively inelastic material. As a more particular example, a length of cover 102 can be made of a relatively elastic polyurethane while another length of cover 102 can be made of a relatively inelastic nylon. As another example, cover 102 can have a length that is configured to be relatively inelastic and a length that is configured to be relatively elastic by applying a different degree of tension to each length when ventilated mattress 100 is in an expanded position. As a more particular example, cover 102 can be configured such that, when in an expanded position, frame bars 104 apply relatively little tension to the relatively elastic length of cover 102 while frame bars 104 apply relatively more tension to the relatively inelastic length of cover 102.

In some embodiments, frame bar 104, hinge plate 106, and folding arm 112 can include any suitable structural material. For example, frame bar 104, hinge plate 106, and folding arm 112 can include a relatively rigid structural material such as plastic, aluminum, graphite, any other suitable relatively rigid structural material, and/or any combination thereof.

In some embodiments, frame bar 104 and folding arm 112 can have any suitable shape. In one example, frame bar 104 and/or folding arm 112 has a shape configured to minimize contact with the portion of cover 102 that is provides the sleeping support surface. As a more particular example, frame bars 104 and/or folding arms 112 can have an oval shape, an oblong shape, a semicircular shape, any other suitable shape, and/or any suitable combination thereof.

In some embodiments, a hinge plate 106 is attached to two frame bars 104 and to two folding arms 112 via a hinge 114 in any configuration suitable to create a collapsible mattress frame. For example, a hinge plate 106 can be attached at or near the ends of frame bars 104, and configured to hold frame bars 104 parallel or substantially parallel. To continue the example, hinge plates 106 can be attached to folding arms 112 via hinges 114 such that a user can cause folding arms 112 to collapse inward relative to the mattress frame.

In some embodiments, hinge plates 106 are attached to frame bars 104 via track 110. For example, hinge plate 106 can include a protrusion configured to fit within a cavity of track 110. In such an example, the protrusion can have any shape suitable for fitting within track 110. As a more particular example, hinge plate 106 can include a circular, semicircular, or ovular protrusion configured to fit inside a circular, semicircular, or ovular shape of the cavity of track 110. As another more particular example, hinge plate 106 can include a substantially triangular protrusion configured to fit inside a substantially triangular cavity of track 110.

In some embodiments, hinge plate 106 and track 110 can be configured to allow a user to slide hinge plate 106 along track 110 and to cause hinge plate 110 to snap and/or lock into place at or near the end of frame bars 104. For example, track 110 can include a snapping mechanism configured to protrude into a cavity of track 110 and snap into place when hinge plate 106 is moved to a position at or near the ends of frame bars 104. As another example, track 110 can be configured to include a protrusion into the cavity in order to prevent hinge plate 106 from sliding too far toward the center of frame bars 104. In such an example, cover 102, enclosure mechanism 108, track 110 and hinge plate 106 can be configured to allow a user to slide hinge plate 106 into track 110 and secure hinge plate 106 in place by using enclosure mechanism 108 to fasten cover 102 to itself, thereby applying a pressure appropriate to hold hinge plate 106 in place.

In some embodiments, hinge plate 106, track 110, and cover 102 can be configured to allow a user to slide hinge plate 106 along track 110 and to cause hinge plate 106 to snap and/or lock into place at or near the end of frame bars 104 while cover 102 is in place such that upon hinge plate 106 snapping and/or locking into place, ventilated mattress 100 is in a configuration appropriate for sleeping (i.e., an expanded position), as illustrated in FIGS. 1A and 1*n* FIG. 1B. For example, hinge plate 106 can attach to track 110 while allowing a clearance sufficient to allow hinge plate 106 to slide on track 110 even when cover 102 is located between hinge plate 106 and frame bar 104. In some embodiments, hinge plate 106 can be immovably attached to track 110, such as by welding, gluing, riveting, soldering, any other suitable method of immovable attachment, and/or any combination thereof.

In some embodiments, hinge plate 106, track 110, and cover 102 are configured to allow a user to slide cover 102 in place along track 110. For example, cover 102 can include protrusions at its edges configured to slide within track 110 such that upon a user moving ventilated mattress 100 into an expanded position, track 110 creates tension in cover 102 via the protrusions in order to form an appropriate sleeping surface on cover 102.

In some embodiments, hinge plate 106, track 110, and cover 102 can be configured to allow a user to slide cover 102 in place along track 110 when hinge plates 106 are in a fixed position. For example, two or more of hinge plates 106 can be attached to frame bars 104 without the use of track 110 (e.g., via an immovable attachment method, as described above), and can have a size and a shape that allows the full length of track 110 to be open and/or exposed, thereby allowing a user to slide cover 102 in place along track 110 even when hinge plate 106 is in place. As a more particular example, as shown in FIGS. 1B and 1C, hinge plate 106 can have a size and shape that is substantially similar to outline 118, which does not extend past track 110.

In some embodiments, cover 102 and folding arms 112 can be configured to attach in order to apply tension to cover 102 when ventilated mattress 100 is in an expanded position. For example, cover 102 can and folding arms 112 can include a fastening mechanism, such as a button, clip, snap, any other suitable fastening mechanism, and/or any combination thereof.

In some embodiments, folding arms 112 and hinges 116 can be configured to allow a user to collapse folding arms 112 completely such that each pair of folding arms that are attached by a hinge 114 can be folded far enough to make flush or substantially flush contact upon each other. For example, as illustrated in FIG. 1D, hinge 116 can protrude inward relative to the mattress frame and connect four folding arms 112 with a clearance between folding arms 112 that can allow the folding arms to be rotated about hinge 116 by ninety degrees without the ends of folding arms 112 making contact with each other.

In some embodiments, hinge 114 and hinge 116 can be configured to lock and/or unlock by including a button, switch, and/or any other suitable mechanism for locking and/or unlocking. For example, hinge 116 can include a button such that, if ventilated mattress 100 is locked into an expanded position, a user pressing the button can cause hinge 116 to unlock and allow movement of folding arms 112, such that ventilated mattress 100 can enter a collapsed position.

In some embodiments, cover 102, frame bars 104, and hinge plates 106 can be configured such that, when ventilated mattress 100 is in an expanded position, ventilated mattress 100 has a hollow area with ventilation openings formed by a space between frame bars 104 and cover plates 106, the openings appropriate for allowing air to flow through the mattress, as shown in FIGS. 1A, 1B and 1C.

Figure 2:
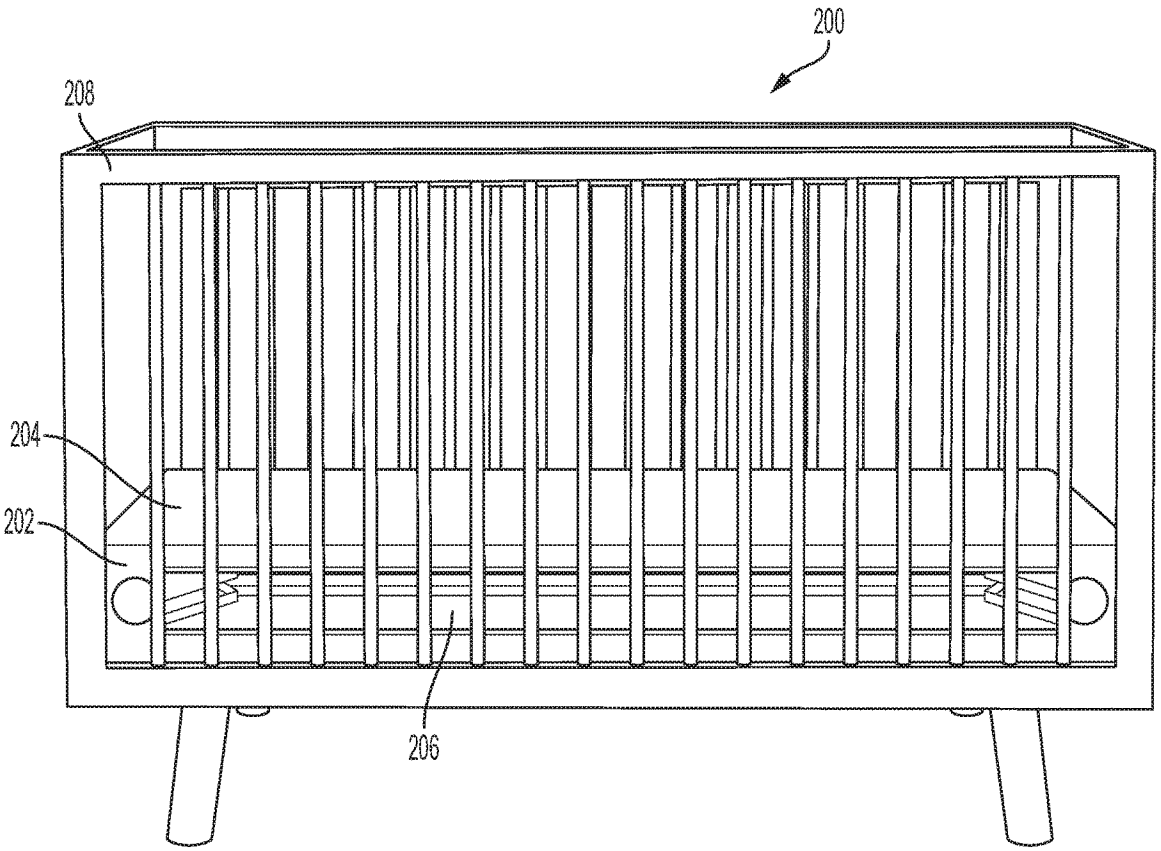
FIG. 2 is a side perspective view of the mattress of FIG. 1A placed in a crib.

Turning to FIG. 2, an example 200 of a ventilated mattress placed in a crib assembly is shown in accordance with some embodiments of the disclosed subject matter. As illustrated, ventilated mattress 202 can be placed inside a crib assembly 208 in some embodiments, and can include a sleeping surface 204 and a ventilation opening 206 in some embodiments.

In some embodiments, ventilated mattress 202 can be any suitable ventilated mattress, such as ventilated mattress 100, as described above in connection with FIGS. 1A, 1B, 1C, and 1D.

In some embodiments, ventilation opening 206 and crib structure 208 can be configured to allow air to flow through ventilation opening 206. For example, as illustrated in FIG. 2, crib structure 208 can have vertical bars that extend across ventilation opening 206 but do not prevent air from flowing through ventilation opening 206.

In some embodiments, at least some of the above described parts of the ventilated mattress of FIGS. 1A, 1B, 1C, 1D, and 2 can be omitted.

In some embodiments of the disclosed subject matter, the ventilated mattress described herein can include a collapsible frame and a cover. The cover can, for example, be made from a washable, hypoallergenic, and/or air permeable material or materials. The cover can be attached to the frame such that when the frame is in an expanded position the cover is drawn tight and forms a sleeping surface. This configuration can form a hollow area beneath the sleeping surface such that air can pass through the ventilated mattress, thereby preventing the buildup of gases within the ventilated mattress.

In some embodiments, the ventilated mattress described herein can be configured to be reversible such as to have a firm sleeping surface that is relatively firm and to have a soft sleeping surface that is relatively soft.

In some embodiments, the ventilated mattress described herein can include a frame that is configured to collapse and/or fold such as to facilitate transportation and/or storage. The frame can include joints configured to lock in place when the frame is in a collapsed position and/or in an expanded position.

In some embodiments, the ventilated mattress described herein can include a sleep computer module that is configured to monitor information about a child user and provide the information to a guardian of the child user. For example, a sleep computer module can be located within in the hollow area of the mattress and include a thermal night vision camera to detect the movement, position, and temperature of a child sleeping on the mattress. As another example, a sleep computer module can provide soothing noises to assist a child in falling asleep.

Figure 3:
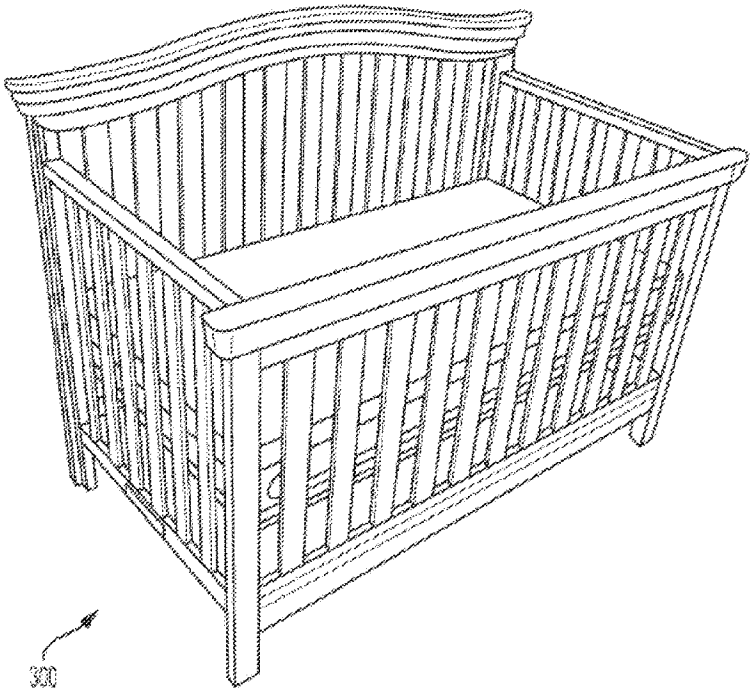
FIG. 3 is perspective view of a second embodiment mattress.
Figure 4:
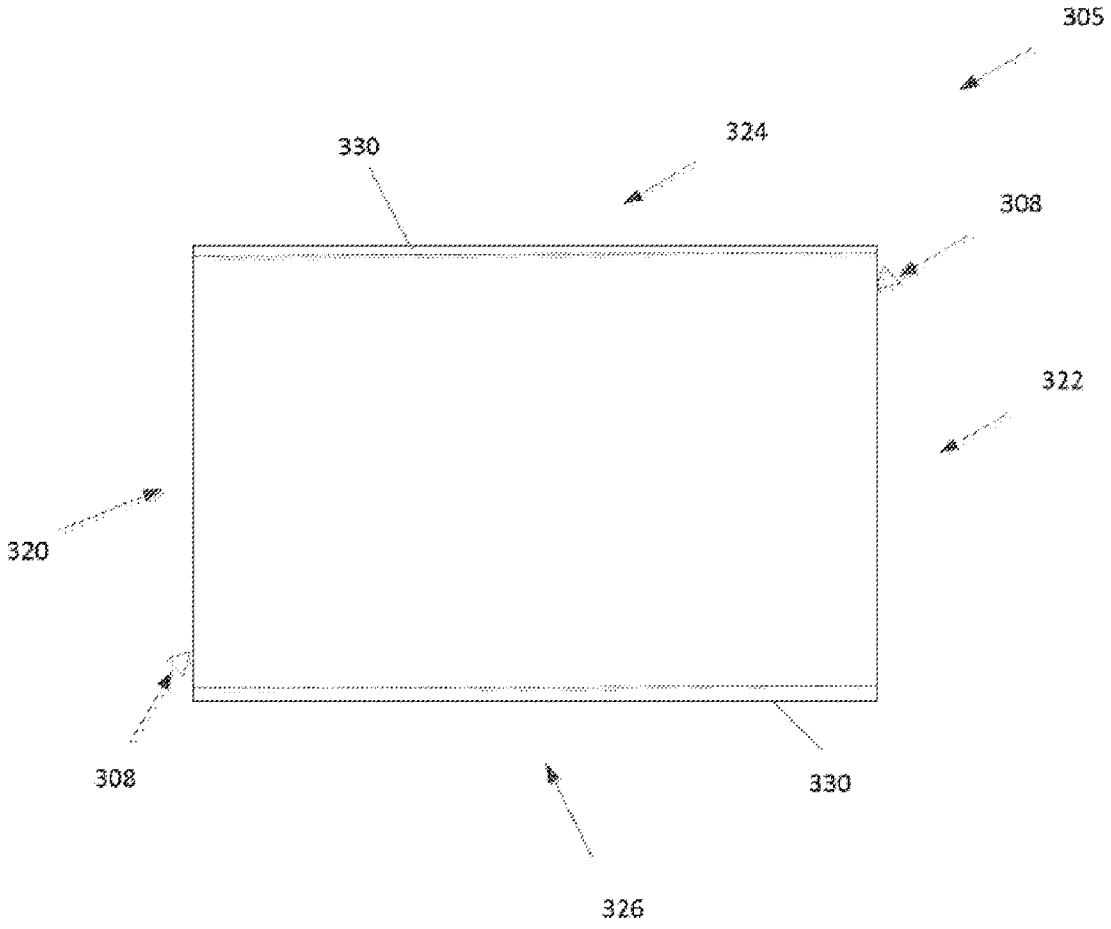
FIG. 4 is a top plan view of a cover of the mattress of FIG. 3.

FIG. 3 shows another embodiment mattress 300. Mattress 300 includes cover 302 and frame 304. Cover 302 is similar to cover 102. Cover 302 includes two sides, upper side 305, FIG. 4, and lower side 307. It should be appreciated that mattress 300 is reversible such that either side 305, 307 can be vertically higher than the other in use. Sides 305, 307 are constructed from fabric had have enclosure mechanisms 308 coupled to opposing ends 320, 322. Ends 324, 326 of sides 305, 307 include sleeves 330 or other thickness elements that run substantially the length of ends 324, 326. In use, sleeves 330 are slid into tracks 310. The width of sleeves 330 (or diameter of sleeves 330, if round) is greater than the width of an opening 332 of tracks 310 such that once slid into tracks 310 from a longitudinal end thereof, sleeves 330 are unable to exit tracks 310 by passing through the opening 332. As such, the cover 302 is coupled to the frame along the substantially full length of the mattress 300.

Figure 5:
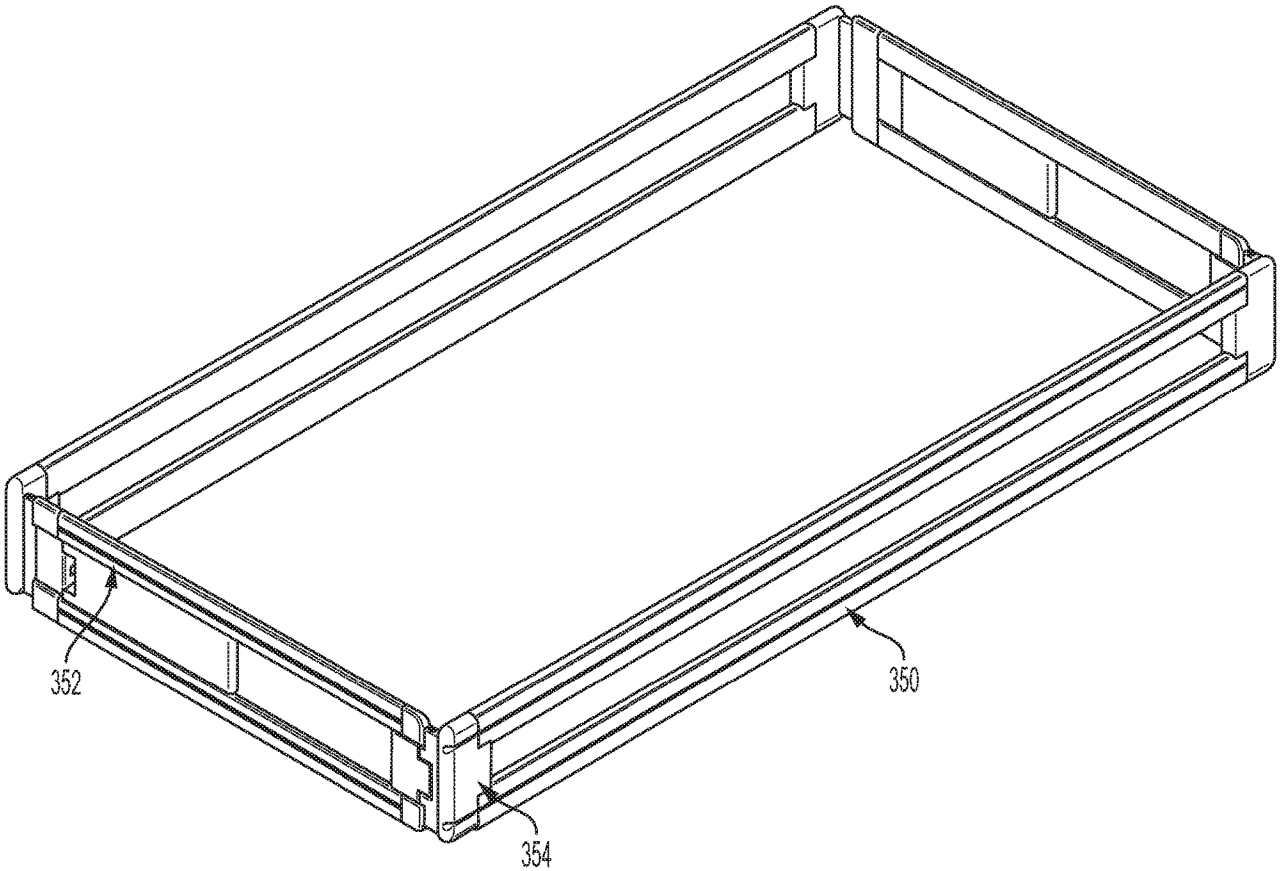
FIG. 5 is a perspective view of an expanded frame of the mattress of FIG. 3.

Frame 304, FIG. 5, includes longitudinal bars 350, width bars 352, first hinges 354, and second hinge mechanisms 356. Longitudinal bars 350 are illustratively longer than width bars 352, but this need not be the case. Longitudinal bars 350 and width bars 352 illustratively have a common cross-sectional shape, but again, this need not be the case.

Longitudinal bars 350 (and width bars 352) have rounded corners 358 and have tracks 310 defined along their length. Width bars 352 further include hinge holes 360 defined therein. Each side of frame 304 includes an upper and a lower bar (350, 352). Hinge holes 360 are located on the side of upper and lower width bars 352 that faces the other (upper or lower) width bar 352 on the same end of mattress 300. Bars 350, 352 are generally hollow and receive portions of hinges 354, 356 therein for coupling thereto. Longitudinal bars 350 are illustratively fixed to hinges 354, 356 via a rivet or other fastener that passes through bars 350 and through a portion of hinges 354, 356. Width bars are likewise coupled between hinges 354, 356 via a rivet or other fastener that passes through bars 350 and through a portion of hinges 354, 356.

Figure 6:
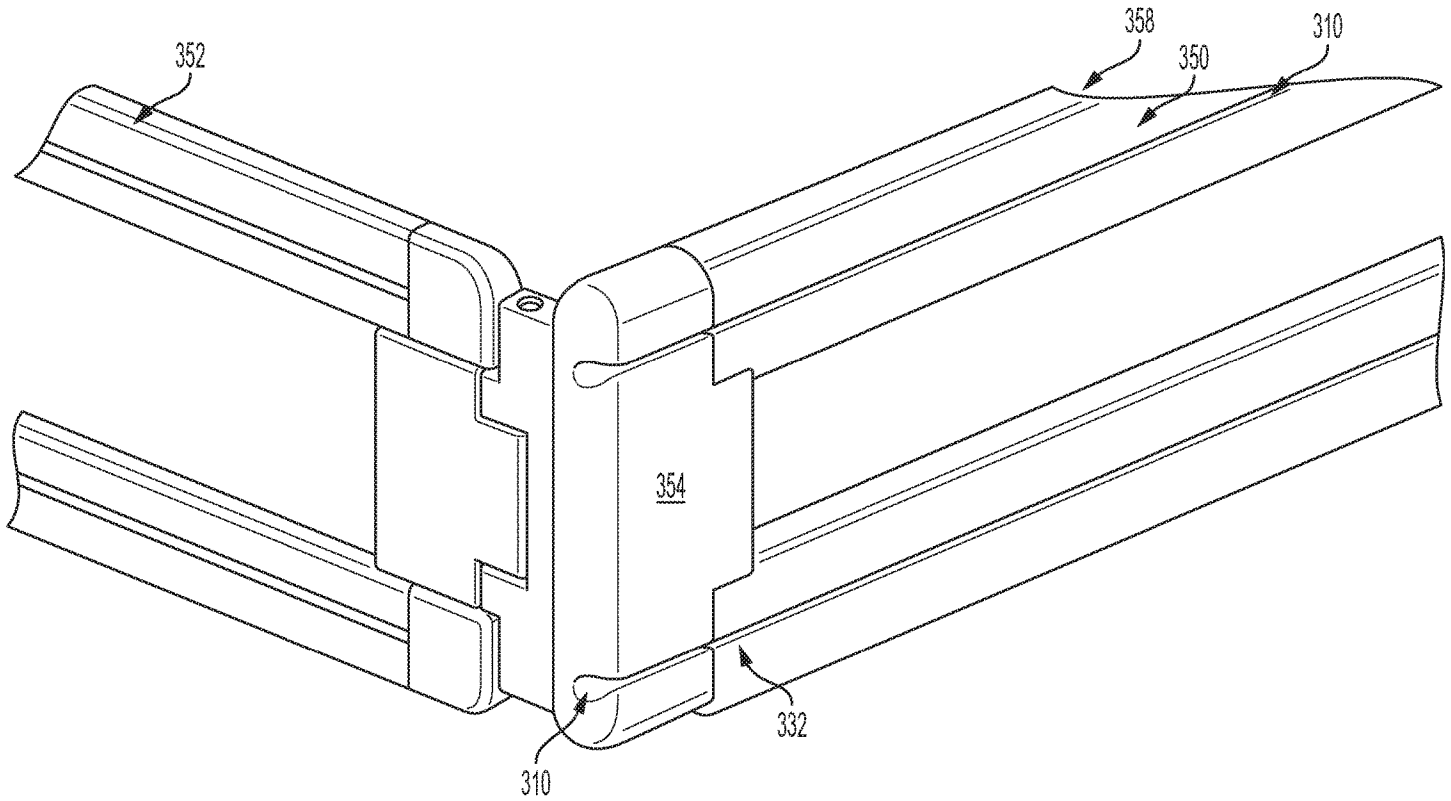
FIG. 6 is a perspective view of a hinge of the frame of FIG. 5.
Figure 7:
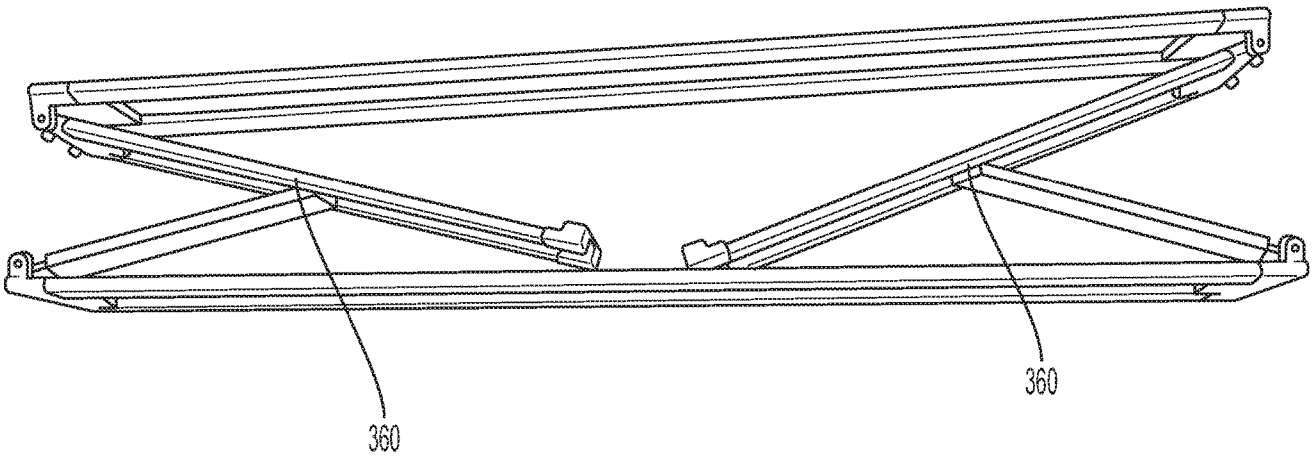
FIG. 7 is top perspective view of the frame of FIG. 5 in a partially collapsed state.
Figure 8:
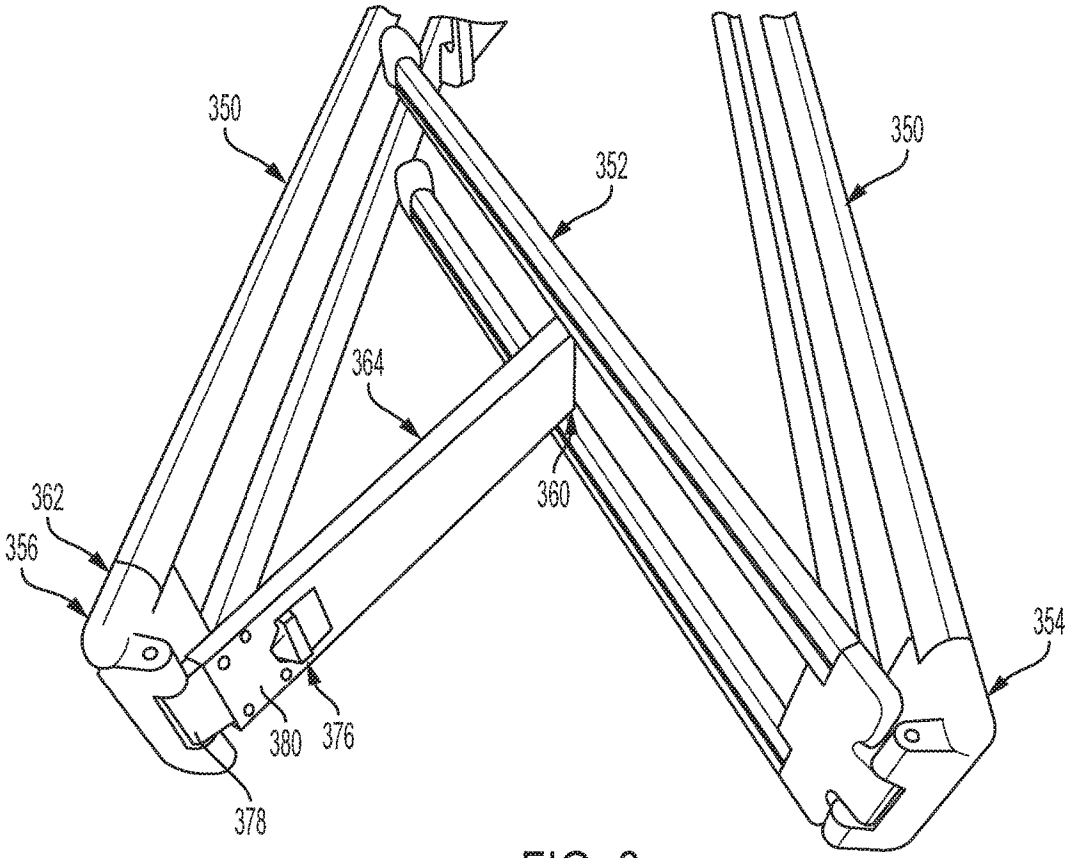
FIG. 8 is a side perspective view of an end of the frame of FIG. 7 in the partially collapsed state.
Figure 9:
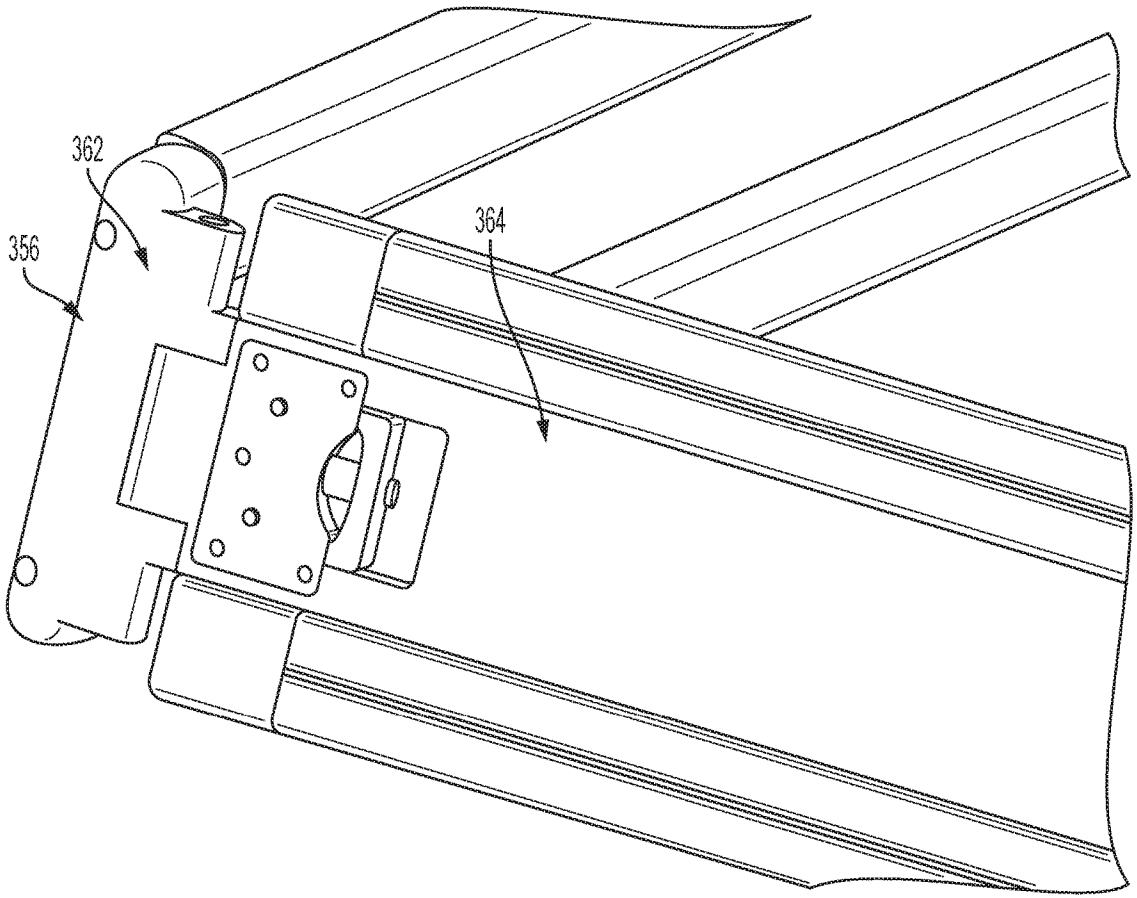
FIG. 9 is a perspective view of a lock hinge of the frame of FIG. 5.
Figure 10:
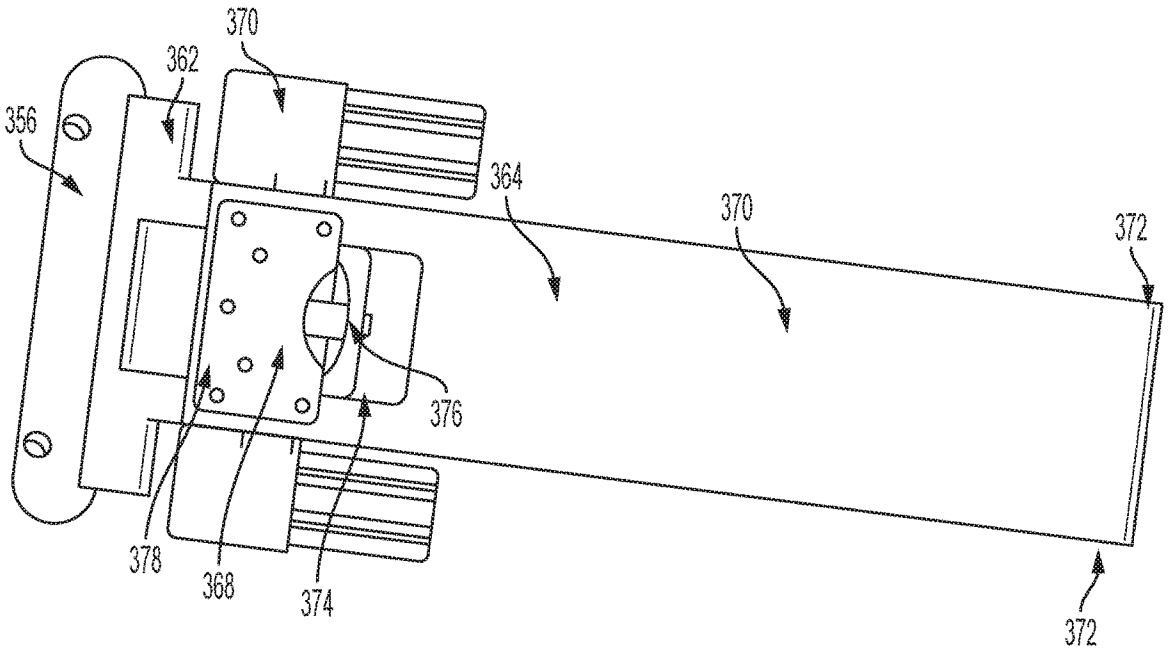
FIG. 10 is another perspective view of the hinge of FIG. 9.

Two first hinges 354 are located on a common lateral side of mattress 300. Two second hinge mechanisms 356 are located on a common lateral side of mattress 300 that is opposite the side having first hinges 356. First hinges 354 are free hinges that do not lock and have approximately 90 degrees of travel. FIG. 6 shows first hinges 354 in the open and expanded position. FIGS. 7 & 8 show first hinges 354 in a partially closed and collapsed position.

Second hinge mechanisms 356 include a fixed hinge member 362 and a pivoting lock member 364. Fixed hinge member 362 and pivoting lock member 364 are joined by a hinge rod to allow hinged movement therebetween. Fixed hinge member 362 is fixed to longitudinal bars 350.

Pivoting lock member 364 includes lock housing 366, lock 368, and detent receiver 370. Lock housing 366 is a generally rectangular element that is sized to fit between width bars 352 when frame 304 is in an expanded position. One end of lock housing 366 includes hinge detents 372. In assembly, hinge detents are received in hinge holes 360 defined in width bars 352 and provide for hinged movement of pivoting lock member 364 relative to width bars 352. Lock housing 366 also includes a lock aperture 374. Lock aperture 374 receives lock 368 therein.

Lock 368 includes release 376, mechanism 378, and detents 380. Lock 368, via mechanism 378 is biased to a locked position in which detents 380 extend out of lock housing 366. Detent receiver is illustratively a plastic piece that is mounted in an end of width bars 352.

A user can pull on release 376 which causes detents 380 to retract into lock housing 366. When frame 304 is in the expanded position, detents 380 that extend out of lock housing 366 engage detent receiver 370. Detents 380 are biased to the position that extends out of lock housing 366. When detents 380 are within detent receiver 370, the detents 380 along with detents 372 provide points of contact that fix the orientation of bars 350, 352 and hold frame 304 in the expanded position. When the release 376 is pulled such that detents 380 are retracted, detent receiver 370 is free to disengage from lock housing 366 to allow frame 304 to assume a collapsed position, FIG. 7.

It should be appreciated that both first hinges 354 and second hinge mechanisms 356 include a continuation of tracks 310 of longitudinal bars 350 such that the tracks 310 extend to an end of the frame 304 and present an open end able to receive sleeves 330.

When frame 304 is in the expanded orientation, FIG. 5, cover 302 is mounted thereto by sliding respective sleeves 330 into respective tracks 310. The exact sizings of cover sides 305, 307 are chosen to provide a desired firmness for that side of mattress 300. Once both sides 305, 307 are mounted, they are coupled together via enclosure mechanisms 308. The mattress 300 is then placed within a crib or otherwise positioned as desired.

When disassembly is desired, a reverse operation is performed. It should be appreciated that disassembly can be partial, where only the cover 302 is removed (such as to be laundered) or where cover 302 remains and frame 304 is collapsed. Cover removal is achieved by disengaging one or more enclosure mechanisms 308 and then sliding cover 302 off until sleeves 330 fully disengage tracks 310.

Collapse of frame 304 with the cover 302 still thereon is achieved in the same manner as when the cover 302 is off. Lock 368 is positioned in second hinge mechanisms 356 such that it accessible and operable by a user with the cover 302 thereon.

Figure 11:
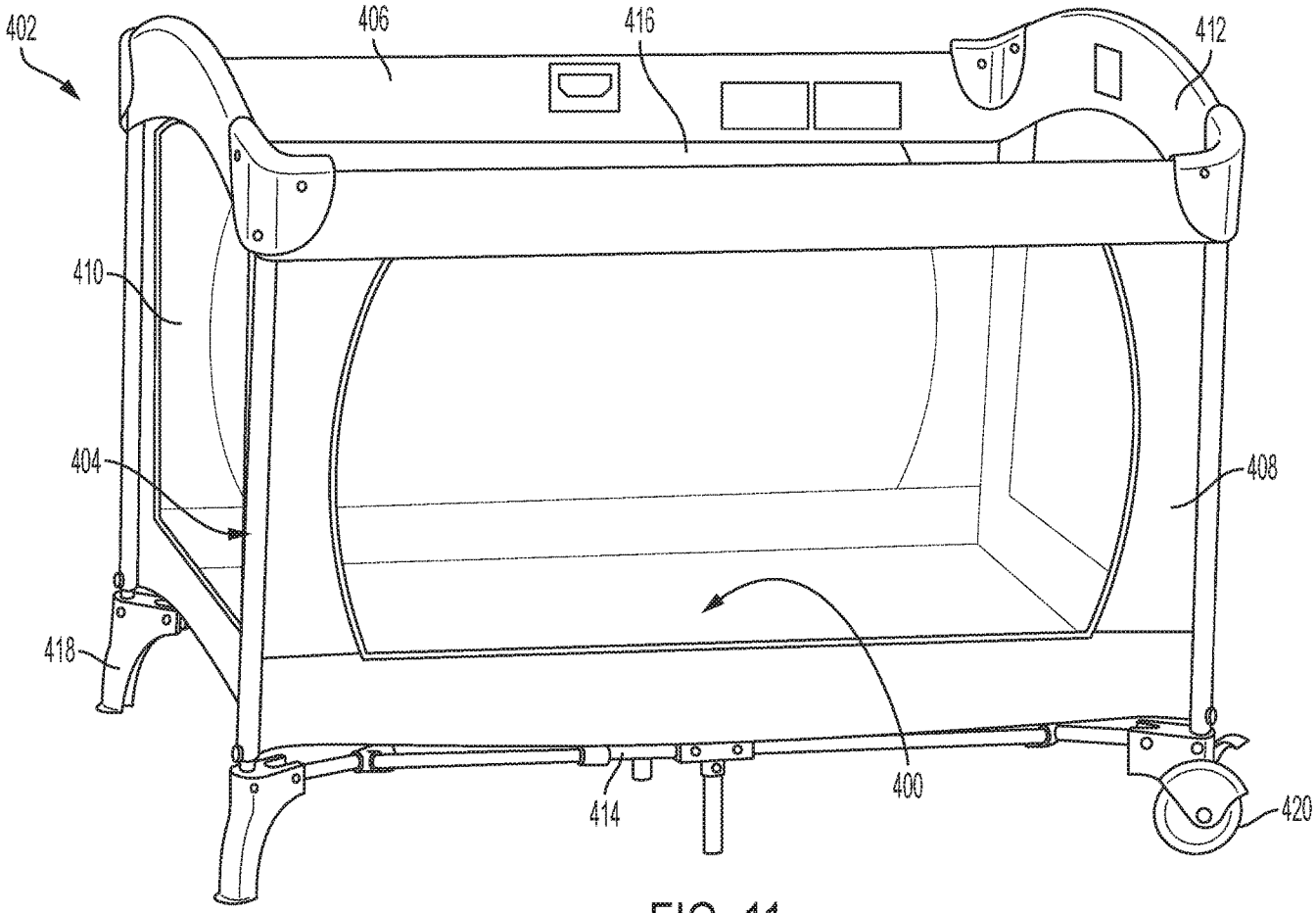
FIG. 11 is a perspective view of a playard having a mattress according to another embodiment of the present disclosure.

Referring now to FIG. 11, an alternative embodiment of a mattress according to the present disclosure is shown. In this embodiment, mattress 400 is specifically designed for use as a sleeping surface for a playard, such as playard 402. As illustrated, a typical playard 402 generally includes a frame 404 that, along with fabric defines a pair of side walls 406, 408, a pair of end walls 410, 412 and a bottom wall 414. Side walls 406, 408 and end walls 410, 412 define an opening 416 through which a child is placed into or removed from playard 402. In certain embodiments, frame 404 includes feet 418 and/or wheels 420. As depicted in FIG. 11, when in use mattress 400 is placed through opening 416 and disposed on bottom wall 414 to function as the lower surface of playard 402.

Figure 12:
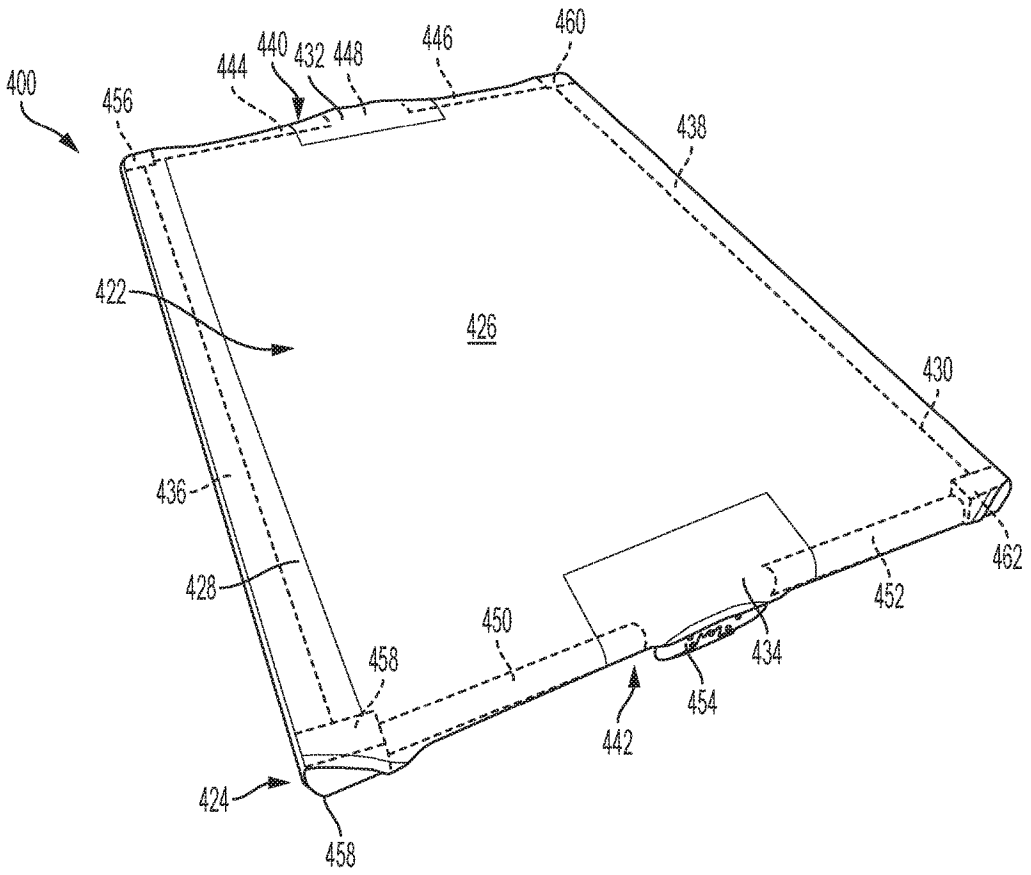
FIG. 12 is a perspective view of the top of the mattress of FIG. 11.

Referring now to FIG. 12, mattress 400 generally includes a cover 422 and a frame 424. Cover 422 generally includes a main field 426, a pair of opposed side segments 428, 430 and a pair of opposed end segments 432, 434. Frame 424 generally includes a pair of opposed side bars 436, 438 and a pair of opposed end mechanisms 440, 442. End mechanism 440 includes a first arm 444, a second arm 446 and a hinge 448. End mechanism 442 similarly includes a first arm 450, a second arm 452 and a hinge 454. Side bar 436 is coupled to first arm 444 of end mechanism 440 by coupling 456. Side bar 436 is also coupled to first arm 450 of end mechanism 442 by coupling 458. Side bar 438 is coupled to second arm 446 of end mechanism 440 by coupling 460. Side bar 438 is also coupled to second arm 452 of end mechanism 442 by coupling 462. First arm 444 and second arm 446 of end mechanism 440 are also coupled to hinge 448. First arm 450 and second arm 452 of end mechanism 442 are also coupled to hinge 454.

Figure 13:
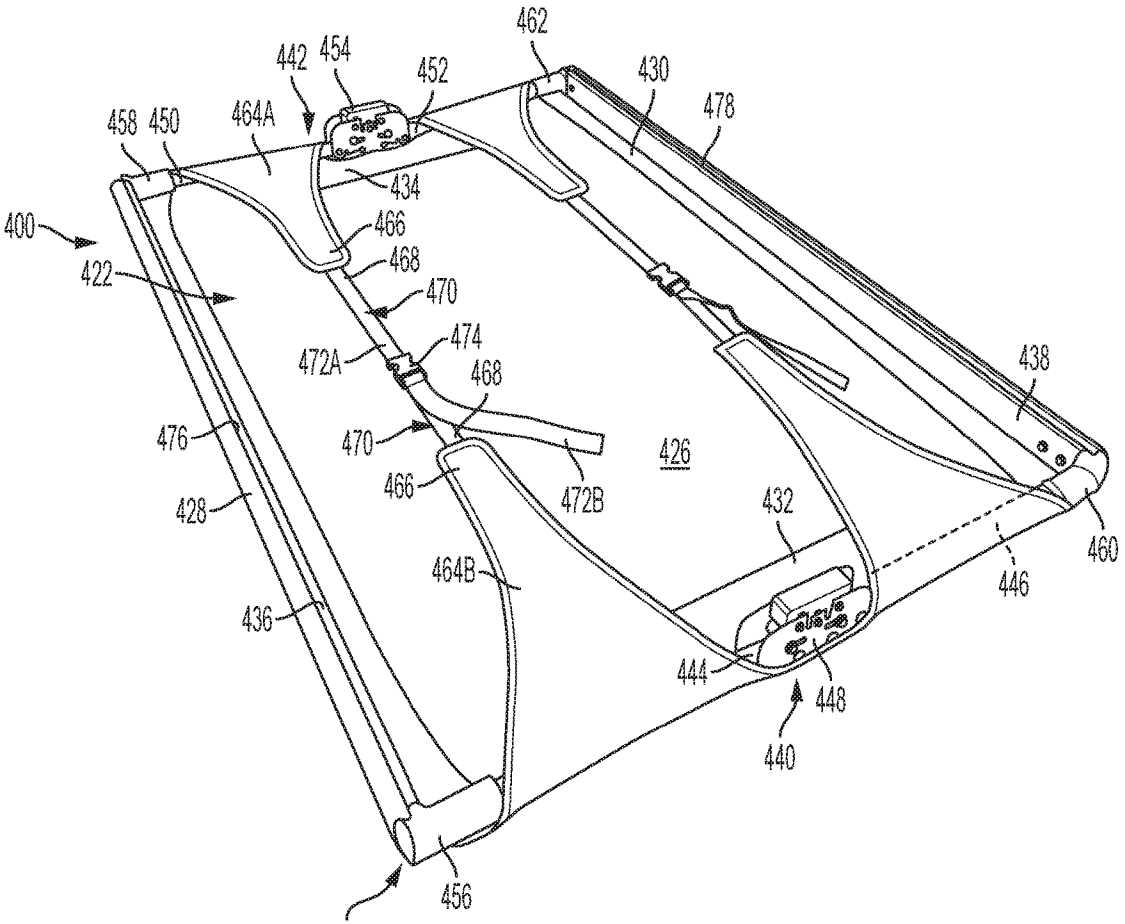
FIG. 13 is a perspective view of the bottom of the mattress of FIG. 11.

Referring now primarily to FIG. 13, cover 422 of mattress 400 further includes a plurality of extensions 464 that extend from main field 426. Each extension 464 includes an end 466 that is secured (such as by sewing) to an end 468 of a strap 470. The other end 472 of each strap 470 is coupled to a fastener 474. In the embodiment depicted in FIG. 13, fastener 474 is a buckle, and end 472A of extension 464A is fixedly secured to fastener 474. End 472B of extension 464B is looped through fastener 474 and may be adjusted in a conventional manner to adjust the tension between extensions 464A and 464B, thereby adjusting the tension on main field 426. As shown, extension 464A is folded over arm 450 between coupling 458 and hinge 454 and extension 464B is folded over arm 444 between coupling 456 and hinge 448. The other extensions 464 are similarly located.

It should be understood that any of a variety of other structures for securing cover 422 to frame 424 and adjusting the tension on cover 422. Extensions 464 may be replaced with straps or other connection mechanisms to attach cover 422 to frame 424. Frame 424 may include adjustment mechanisms to apply tension to cover 422. The buckles of fasteners 474 may be replaced by snaps, hook-and-loop fasteners, etc.

As is also depicted in FIG. 13, side segment 428 of cover 422 is fixedly secured within a slot 476 formed along a lower surface of side bar 436. Similarly, side segment 430 of cover 422 is fixedly secured within a slot 478 formed along a lower surface of side bar 438. In certain embodiments, side segments 428, 430 may be removed from slots 476, 478 for cleaning of cover 422. When mattress 400 is in its expanded state as depicted in FIGS. 11-13, cover 422 is stretched taught between side bars 436, 438 and end mechanisms 440, 442. It should be understood that in other embodiments, slots 476, 478 are replaced by other connection mechanisms to secure cover 422 to side bars 436, 438 such as snaps, buttons, hook-and-loop fasteners, etc.

Hinges 448, 454 of frame 424 may be designed in a variety of suitable configurations. In one embodiment, hinges 448, 454 are lower profile hinges than those shown in FIG. 13 and do not protrude from main field 426 farther than side bars 436, 438. Each hinge 448, 454 may include a body having one or more pivot mechanisms which permits the arms coupled to the hinge to pivot relative to the body toward one another, thereby permitting mattress 400 to move into a collapsed state. Each hinge 448, 454 may also include a locking mechanism which locks the arms relative to one another when mattress 400 is in the expanded state. The locking mechanism may be configured to be activated by a button or switch to unlock and permit relative movement of the arms.

When mattress 400 is in the expanded state and positioned within playard 402, it forms a flat or substantially flat surface suitable for supporting a child during sleep. When in the collapsed state, mattress 400 is effectively reduced in size for transport and storage.

Figure 14:
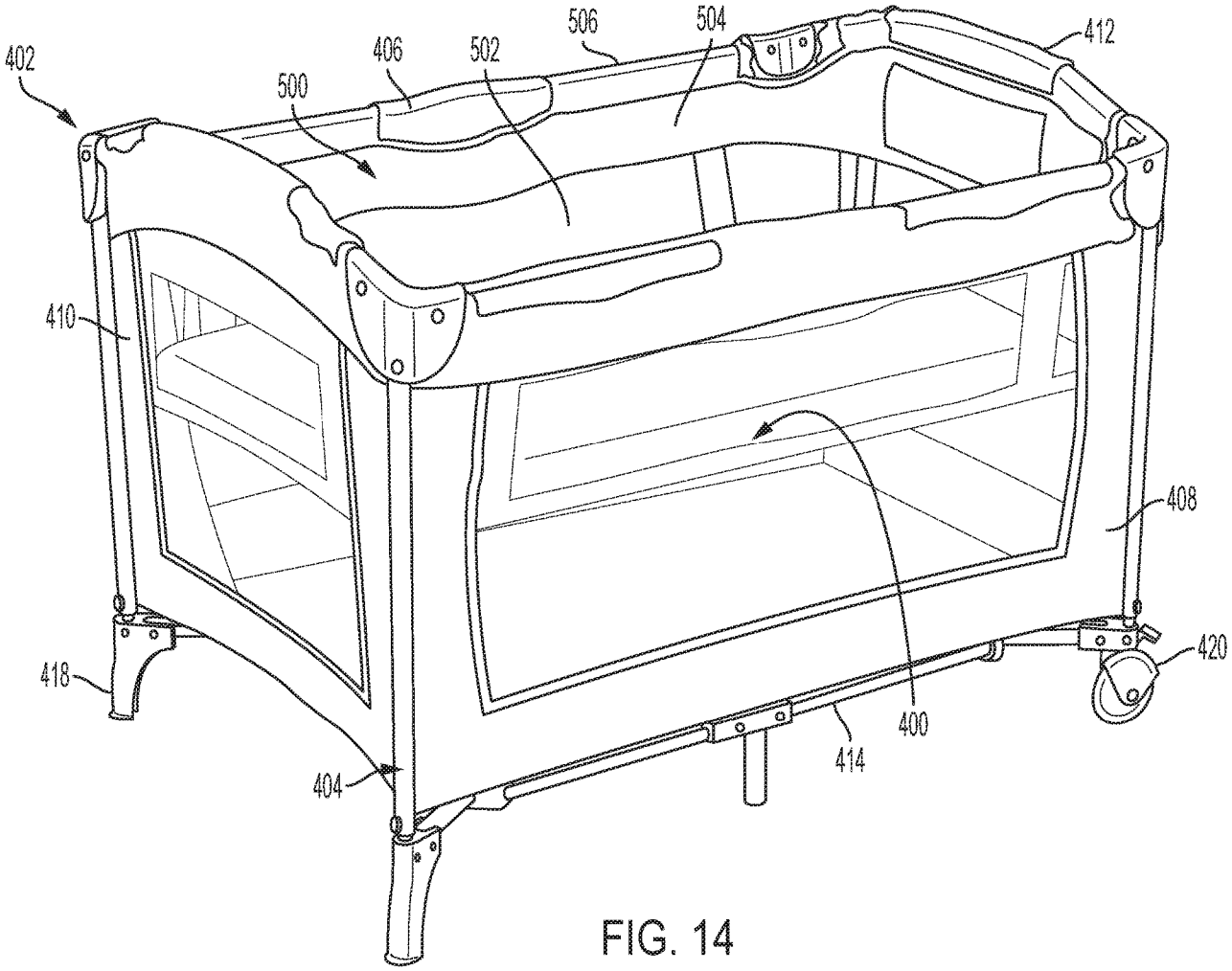
FIG. 14 is a perspective view of a mattress according to the present disclosure used in a bassinet mode.

Referring now to FIG. 14, mattress 400 is depicted in use in a bassinet mode. Certain playards such as playard 402 depicted in FIG. 14 include a bassinet option for use by small children or infants (e.g., infants under 4 months old and less than 15 pounds). Bassinet assembly 500 is shown assembled in playard 402. Bassinet assembly 500 essentially forms a basket that is suspended in playard 402 and includes a plurality of side walls, each having a mesh portion 502 and a fabric or plastic portion 504. A plurality of clips 506 are attached to portions 504 and configured to clip over the upper rails of side walls 406, 408 and end walls 410, 412 of playard 402. Bassinet assembly 500 further includes a lower wall (not shown) that extends between the mesh portions 502. In some embodiments, a pair of frame members (not shown) are inserted in sleeves (not shown) in the lower wall of bassinet assembly 500 and extend along the length of the lower wall to provide rigidity to the lower wall. In conventional embodiments, a foldable, solid mattress or sleep surface is placed over the lower wall of bassinet assembly 500 after the frame members are installed. In FIG. 14, mattress 400 is used instead of the conventional solid mattress to provide the benefits described herein.

In one embodiment, mattress 400 is configured to have dimensions matching regulated standards for playards. As a more particular example, mattress 400 can have a sleeping surface that is 37.5 inches long and 25.5 inches wide.

In some embodiments, cover 422 includes any suitable air permeable material or materials. For example, cover 422 illustratively includes one or more of a mesh material, a plastic, a fabric, and/or any other suitable air permeable material. As a more particular example, cover 422 includes a washable, air permeable mesh material, such as a plastic mesh, a fiber mesh, a composite mesh, any suitable washable, air permeable mesh material, and/or any combination thereof. As a still more particular example, cover 422 can be made from the Extinct-Spacer mesh material supplied by Cosmo Hong Kong Limited, Zhongshan City, Guangdong, China.

In some embodiments, cover 422 can include a hypoallergenic material. For example, cover 422 can include a polyester fiber material, silk, cotton, any other suitable hypoallergenic material, and/or any suitable combination thereof.

In some embodiments, frame 424 can include any suitable structural material. For example, frame 424 can include a relatively rigid structural material such as plastic, aluminum, graphite, any other suitable relatively rigid structural material, and/or any combination thereof.

In some embodiments, frame 424 can have any suitable shape. In one example, frame arms 444, 446, 450, 452 have a shape configured to minimize contact with the portion of cover 422 that provides the sleeping support surface. As a more particular example, arms 444, 446, 450, 452 can have an oval shape, an oblong shape, a semicircular shape, any other suitable shape, and/or any suitable combination thereof.

Any of the features of the mattress embodiments described herein may be included in or omitted from mattress 400.

While this disclosure has been described as having an exemplary design, the present disclosure may be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains.

As used herein, the modifier "about" used in connection with a quantity is inclusive of the stated value and has the meaning dictated by the context (for example, it includes at least the degree of error associated with the measurement of the particular quantity). When used in the context of a range, the modifier "about" should also be considered as disclosing the range defined by the absolute values of the two endpoints. For example, the range "from about 2 to about 4" also discloses the range "from 2 to 4."

The connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements. The scope is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B or C may be present in a single embodiment; for example, A and B, A and C, B and C, or A and B and C.

In the detailed description herein, references to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art with the benefit of the present disclosure to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f), unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus

The invention claimed is:

1. A mattress configured to form a sleeping surface in a playard, comprising:

an air permeable cover; and a frame including a pair of side bars and a pair of end mechanisms extending between the side bars;

wherein the cover includes a main field and a plurality of extensions that extend from the main field, each of the extensions, when the mattress is in an expanded state and positioned within the playard, being folded over one end mechanism and adjustably coupled to another extension folded over another end mechanism that is opposite the one end mechanism;

wherein the cover includes a pair of side segments that extend from the main field and are configured to be fixedly secured to the pair of side bars; and wherein each of the pair of end mechanisms includes a hinge that permits movement of the mattress between an expanded state and a collapsed state.

2. The mattress of claim 1, wherein the air permeable cover is formed from at least one of a mesh material, a plastic or a fabric.

3. The mattress of claim 1, wherein the air permeable cover is formed from a hypoallergenic material.

4. The mattress of claim 1, wherein each of the pair of side bars includes a slot that receives a side segment of the cover.

5. The mattress of claim 1, wherein each of the pair of side bars is connected to the pair of end mechanisms by a pair of couplings.

6. The mattress of claim 1, wherein each of the pair of end mechanisms includes a first arm, a second arm and a hinge coupled to the first arm and the second arm to permit the first arm and the second arm to pivot toward one another to move the mattress into the collapsed state.

7. The mattress of claim 6, wherein the first arm of each of the pair of end mechanisms is coupled to one of the pair of side bars and the second arm of each of the pair of end mechanisms is coupled to another of the pair of side bars.

8. The mattress of claim 1, wherein each of the plurality of extensions is connected to one end of a strap, another end of each strap being coupled to a fastener.

9. The mattress of claim 8, wherein the other end of one of the straps is fixedly secured to a fastener and the other end of another one of the straps is adjustably connected to the fastener.

10. The mattress of claim 9, wherein the fastener is a buckle.

11. A mattress configured to form a sleeping surface in a playard, comprising:

an air permeable cover; and a frame including a pair hinges;

wherein the cover includes a plurality of extensions that extend over the frame and opposing extensions of the plurality of extensions are connected together by a fastener that permits adjustment of a relative position of the opposing extensions to adjust a tension applied to the cover;

wherein the cover includes a pair of side segments that are configured to be fixedly secured to the frame; and wherein the pair of hinges permit movement of the mattress between an expanded state and a collapsed state.

12. The mattress of claim 11, wherein the frame further includes a pair of side bars and a pair of end mechanisms extending between the side bars, each of the plurality of extensions being configured to fold over one end mechanism.

13. The mattress of claim 12, wherein each of the pair of side bars includes a slot that receives a side segment of the cover.

14. The mattress of claim 12, wherein each of the pair of end mechanisms includes a first arm, a second arm and a hinge coupled to the first arm and the second arm to permit the first arm and the second arm to pivot toward one another to move the mattress into the collapsed state.

15. The mattress of claim 14, wherein the first arm of each of the pair of end mechanisms is coupled to one of the pair of side bars and the second arm of each of the pair of end mechanisms is coupled to another of the pair of side bars.

16. The mattress of claim 11, wherein each of the pair of side segments is configured to be fixedly secured to one of the pair of side bars.

17. The mattress of claim 11, wherein the air permeable cover is formed from at least one of a mesh material, a plastic or a fabric.

18. The mattress of claim 11, wherein each of the plurality of extensions is connected to one end of a strap, another end of each strap being coupled to a fastener.

19. The mattress of claim 18, wherein the other end of one of the straps is fixedly secured to a fastener and the other end of another one of the straps is adjustably connected to the fastener.

20. A playard, comprising:

a pair of side walls;

a pair of end walls;

a bottom wall;

a bassinet assembly suspended between the pair of side walls and the pair of end walls above the bottom wall, the bassinet assembly including a bottom wall; and a mattress configured to fit within the bassinet assembly and be supported by the bottom wall of the bassinet assembly, the mattress including an air permeable cover and a frame including a pair hinges;

wherein the cover includes a plurality of extensions that extend over the frame and overlap a main field of the cover, pairs of the plurality of extensions being connected together by a fastener that permits adjustment of a relative position of the extensions in the pairs of extensions to adjust a tension applied to the cover;

wherein the cover includes a pair of side segments that are configured to be fixedly secured to the frame; and wherein the pair of hinges permit movement of the mattress between an expanded state and a collapsed state.

21. A playard, comprising:

a pair of side walls;

a pair of end walls;

a bottom wall; and a mattress configured to fit between the side walls and the end walls and be supported by the bottom wall, the mattress including an air permeable cover and a frame including a pair hinges;

wherein the cover includes a plurality of extensions that extend over the frame and overlap a main field of the cover, pairs of the plurality of extensions being connected together by a fastener that permits adjustment of a relative position of the extensions in the pairs of extensions to adjust a tension applied to the cover;

wherein the cover includes a pair of side segments that are configured to be fixedly secured to the frame; and wherein the pair of hinges permit movement of the mattress between an expanded state and a collapsed state.

* * * * *